US007246511B1

(12) United States Patent
Zhu

(10) Patent No.: US 7,246,511 B1
(45) Date of Patent: Jul. 24, 2007

(54) CABLE GUNLOCK

(76) Inventor: Deming Zhu, Haining First Lock Manufactory, Huan Zhen Bei Road, Changan, Haining, Zhejiang (CN) 314408

( * ) Notice: Subject to any disclaimer, the term of this patent is extended or adjusted under 35 U.S.C. 154(b) by 758 days.

(21) Appl. No.: 09/741,178

(22) Filed: Dec. 21, 2000

(51) Int. Cl.
*E05B 67/06* (2006.01)

(52) U.S. Cl. ..... 70/38 R; 70/38 B; 70/38 C; 70/49; 70/53; 42/70.11

(58) Field of Classification Search ..... 70/49, 70/38 R, 39, 38 A, 38 B, 38 C, 51, 42, 43, 70/53; 42/70.11, 70.04, 70.05, 70.06
See application file for complete search history.

(56) References Cited

U.S. PATENT DOCUMENTS

| | | | | | |
|---|---|---|---|---|---|
| 1,419,469 | A | * | 6/1922 | Paschke | 70/49 |
| 1,515,302 | A | | 11/1924 | George | 70/38 R |
| 1,545,660 | A | * | 7/1925 | Johnson | 70/260 |
| 1,681,409 | A | * | 8/1928 | Johnson | 70/260 |
| 1,688,208 | A | * | 10/1928 | Del Rosso | 70/21 |
| 1,921,434 | A | * | 8/1933 | Stone | 70/259 |
| 2,046,831 | A | * | 7/1936 | Lowe | 70/369 |
| 3,473,352 | A | * | 10/1969 | Foote | 70/38 B |
| 3,605,458 | A | * | 9/1971 | Best | 70/49 |
| 3,765,197 | A | * | 10/1973 | Foote | 70/58 |
| 3,879,721 | A | * | 4/1975 | Yereance | 70/441 |
| 4,033,160 | A | * | 7/1977 | Mima | 70/233 |
| 4,599,875 | A | * | 7/1986 | De Forrest | 70/95 |
| 4,811,578 | A | | 3/1989 | Masoncup et al. | 70/38 B |
| 5,020,259 | A | * | 6/1991 | Mossberg | 42/70.11 |
| 5,394,712 | A | * | 3/1995 | Chou | 70/38 A |
| 5,417,092 | A | * | 5/1995 | Iu | 70/38 A |
| 5,447,043 | A | | 9/1995 | Hwang | 70/49 |
| 5,488,845 | A | * | 2/1996 | Hsieh | 70/38 A |
| 5,921,115 | A | * | 7/1999 | Winner | 70/18 |
| 6,101,852 | A | * | 8/2000 | Steinbach | 70/38 A |

FOREIGN PATENT DOCUMENTS

| | | | | |
|---|---|---|---|---|
| GB | 1520152 | * | 8/1978 | 70/49 |

* cited by examiner

*Primary Examiner*—Lloyd A. Gall
(74) *Attorney, Agent, or Firm*—Stephen C. Wieder

(57) ABSTRACT

A cable gunlock including a lock case with longitudinal bores receiving a fixed shackle and a movable shackle. The movable shackle includes a spring threaded on its end and abutting against the outer surface of the lock case providing an automatic release. A latching member is driven in and out of cooperation with the movable shackle by a locking mechanism and is urged towards the movable shackle by a spring. The latching member has an inverted U-shape and an inclined surface ending in an inwardly cut semircularly shaped edge.

6 Claims, 3 Drawing Sheets

CABLE GUNLOCK

BACKGROUND OF THE INVENTION

1. Field of the Invention

The invention relates to locks and more particularly to a cable locking assembly used to lock guns. The present invention includes a novel automatic release feature and a novel security feature preventing unauthorized or accidental unlocking.

2. Description of Prior Art

A common concern among gun owners is that firearms are stored so that they are not accessible to children or unauthorized persons. Prior art gunlocks may include trigger locks or guards, wall mounted gunlocks or gun cabinets. There are also gunlocks including a locking body and a chain or a cable that is passed through the central aperture of the trigger guard of one or more guns, forming a closed loop.

Some of the conventional cable locks include an operating cam member connected to a spring. One of the major problems of such conventional cable locks used for securing guns is that they can be easily opened when a sudden impact is exerted on the lock, affecting the force of the spring.

Still another drawback of the conventional cable locking devices is that the user has to manually pull out the end of the cable. In the case of cable locks that have a release feature, it usually consists of a spring device incorporated in the locking body. If a small article falls into the cavity where the spring is placed, or if the spring is damaged in any other way, the whole locking assembly would stop functioning.

There are several patents which disclose locking devices having various operating cam members, springs and cable attachments.

Hwang, U.S. Pat. No. 5,447,043 discloses a lock assembly including a cable, lock shell with a keyplug and a flexible shackle with a pushing assembly. The pushing assembly is positioned in a hole in the inside of the lock shell. Instead of a latching member, Hwang discloses a movable locking ball with no attached spring assembly.

George, U.S. Pat. No. 1,515,302 discloses a locking means comprising a locking block and a shackle having parallel legs. The reference includes an operating cam member in the form of a reciprocable bolt that may be moved against the tension of a spring. In one embodiment, the shackle is provided with teeth that cooperate with a beveled end of the bolt. The drawback of this invention is the straight end of the bolt with no semicircular indent, and the lack of a movement restricting tongue for the bolt. There is also no automatic release mechanism for the shackle, requiring the user to manually pull out the shackle.

Masoncup et al., U.S. Pat. No. 4,811,578 disclose a padlock with a shackle mounted for reciprocal movement. A notch is provided on the short end of the shackle for receiving a latch urged by a coil spring. The latch presents an inclined surface, but does not have the other novel features of the present invention. The shackle is propelled outwardly by a coil spring which is located inside the padlock at the end opposite to where the latch cooperates with the shackle.

Best, U.S. Pat. No. 3,605,458 discloses a cable shackle padlock including a secured rotatable shackle heel-piece and a shackle toe-piece allowed to be inserted and removed from the lock. The padlock also comprises a tumbler which appears to be plate-like and has at its end a slot slidable into and out of engagement with a groove in the shackle toe-piece. The bolt also has a cross slot engaging an eccentric lug on a throw member rotatably mounted in a retaining plate that lies immediately below the bolt.

The present invention is distinguished over the prior art in general, and the above mentioned patents in particular by a lock device having a flexible shackle with a spring device mounted on its free end and abutting against the outer surface of the lock case, providing a novel and more convenient release mechanism. The flexible shackle has an annular groove on its cylindrical portion which cooperates with a latching member. The latching member is urged by a spring and presents an inclined surface with a semicircularly shaped outer edge for a tight fit with the annular groove. The inclined surface of the latching member, resulting in a thin edge, requires a narrow annular groove on the flexible shackle, providing a more resistant and durable configuration for the shackle. The shape of the latching member is also novel, including a rectangular tongue which restricts accidental movement and unauthorized use of the gunlock.

SUMMARY OF THE INVENTION

The purpose of the present invention is to provide a gunlock assembly designed to have a secure locking position, even under extreme environmental shock. This invention also relates to an automatic release feature for the gunlock.

The gunlock of the present invention comprises a lock case that receives two shackles. One of the shackles is fixed, while the other one is movable in and out of a longitudinal bore in the lock case. The movable shackle does not require a pulling force upon unlocking of the gunlock due to a spring that urges the shackle out of the bore. The spring is mounted on the end of the movable shackle and abuts against the outer surface of the lock case.

The lock case incorporates a locking mechanism upon the actuation of which a latching member is moved towards or away from an annular groove in the movable shackle. It is an object of the present invention to provide a novel shape for the latching member to prevent unauthorized or accidental unlocking of the gunlock.

DETAILED DESCRIPTION OF THE INVENTION

Figure 1:
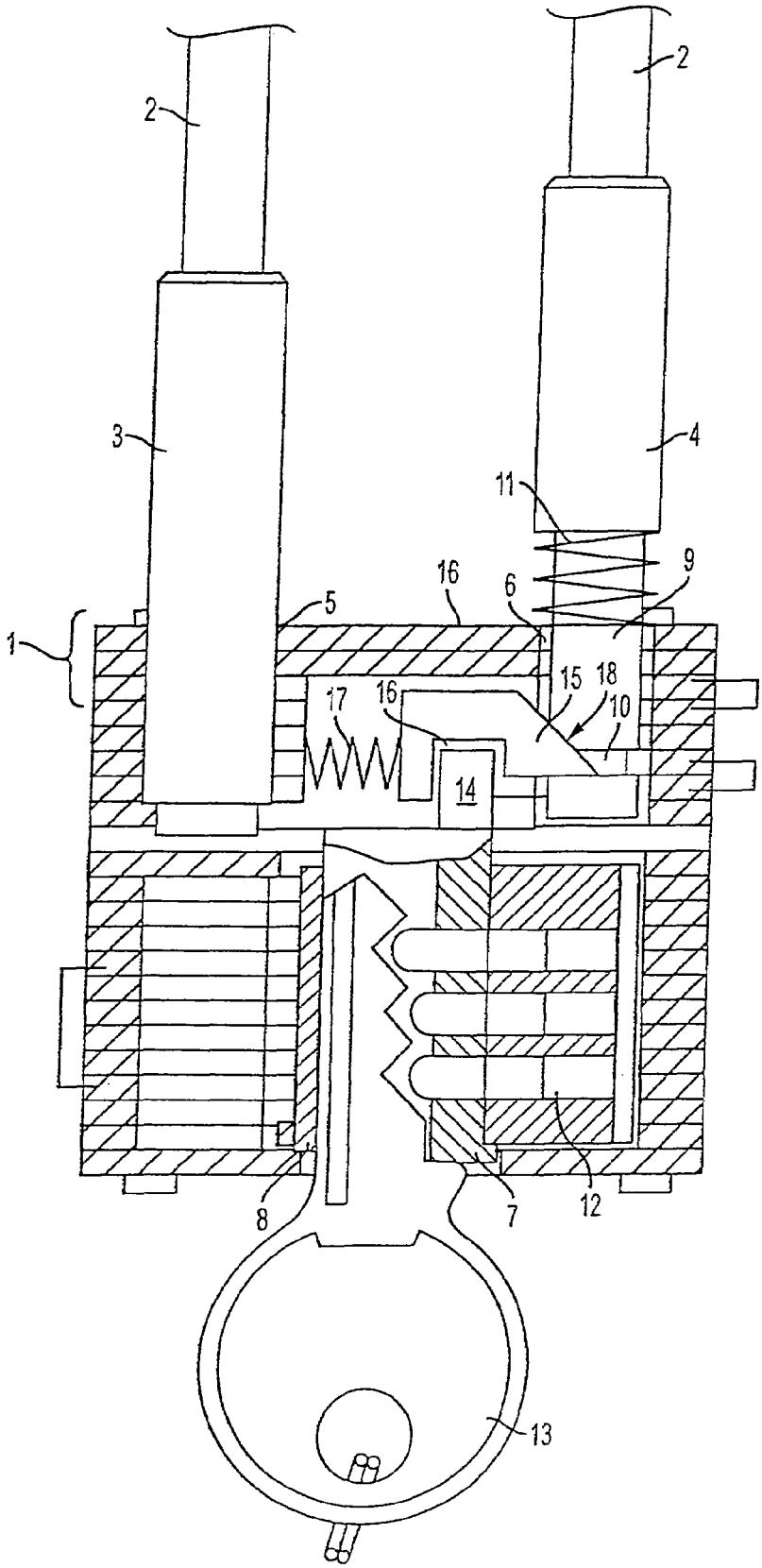
FIG. 1 is a longitudinal section of a gunlock embodying the present invention, in which the latching member is key-operated to permit unlocking of the lock and removal of the flexible shackle.

The gunlock assembly embodying the present invention is shown in FIG. 3 and comprises a lock case (1) and an open loop cable (2). The cable ends on one side in a fixed shackle (3) secured in the lock case (1) and on the opposite side in a movable shackle (4) releasably attached to the lock case (1).

The lock case (1) has two parallel bores (5) and (6) for the reception of the shackles (3) and (4). On the opposite side of the lock case (1) there is a locking mechanism that can be key-operable, electronic, combination, or any other suitable locking means. In FIG. (1), the locking mechanism consists of a key plug (7) mounted in a key plug chamber (8).

The free end of the movable shackle (4) has a cylindrical portion (9) of a smaller diameter so as to be longitudinally received in the bore (6) of the lock case (1). The front or proximal end of the cylindrical portion (9) is provided with an annular groove (10). The movable shackle end (4) is ejected outwardly of the lock case (1) into the unlocked position by means of a spring (11) that abuts against the outer surface of the lock case (1) and is mounted on the back end of the cylindrical portion (9). The spring (11) provides for an automatic release feature for the movable shackle (4) instead of the user having to manually pull it out.

Figures 2X, 2Y:
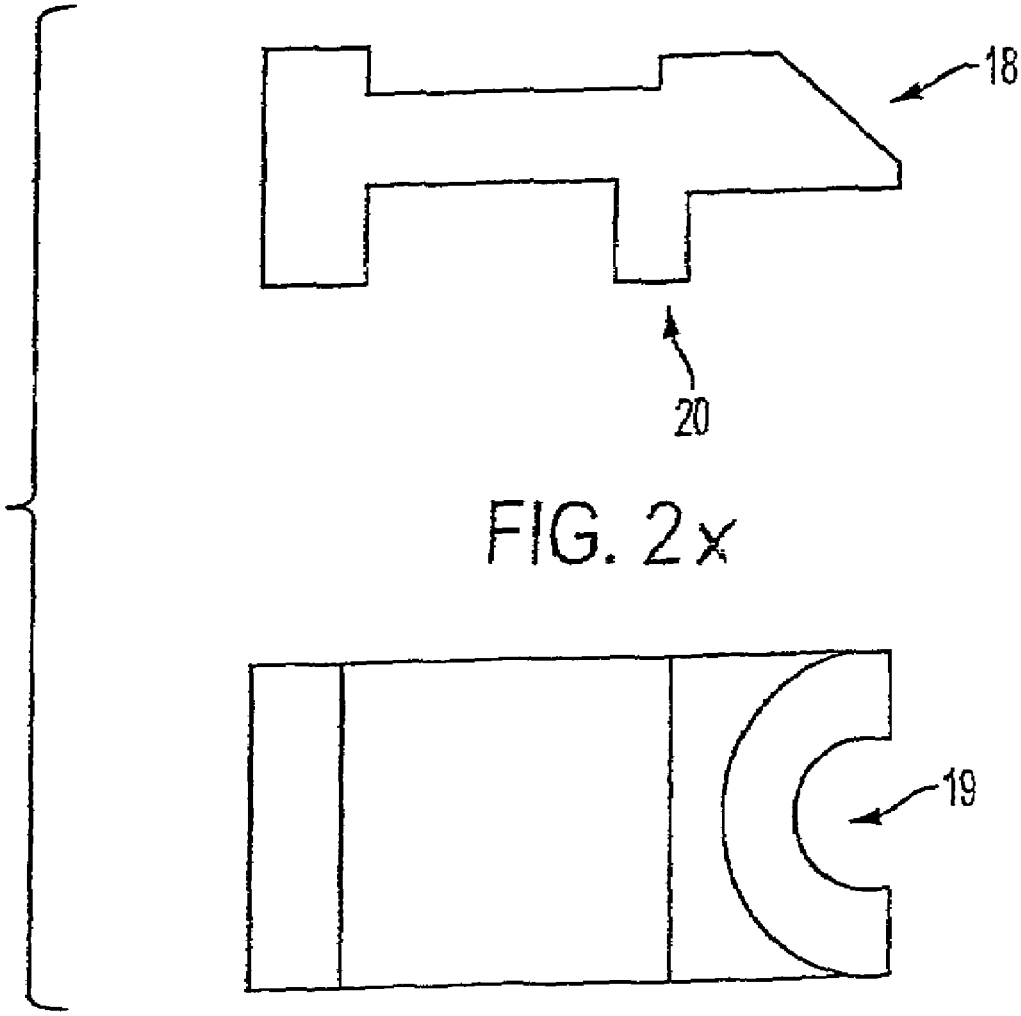
FIG. 2*x* is a side view of the latching member and FIG. 2*y* is a top view of the latching member.

FIG. (1) shows a locking mechanism comprised of a key cylinder tumbler assembly (12) operable by a key (13). The inner end (14) of the key plug (7) is substantially rectangular and is arranged to react with a latching member (15). The latching member (15) comprises an inverted U-shaped structure in plan cross-structure with an inner recess (16) that may have an arcuate or rectangular shape. When the lock mechanism is operated by turning the key (13), the inner end (14) of the key plug (7) will react with the inner recess (16) such that rotation of the key will result in moving the latching member (15) away from the cylindrical portion (9) of the movable shackle (4) against the force exerted by a spring (17). The novel design of the latching member (15) prevents the opening of the gunlock when a hard sudden force is exerted on the lock case (1) which would minimize the force of the spring (17). Thus, the latching member (15) is maintained in a fixed position with respect to the movable shackle (4) even under extreme environmental shock. In the locked position, the spring (17) urges the latching member (15) horizontally towards the cylindrical portion (9) maintaining a tight or frictional fit. FIG. 2*x* shows the end of the latching member nearest the movable shackle (4) having a downwardly inclined surface (18). FIG. 2*y* shows the latching member (15) ends in an inwardly cut semicircularly shaped edge (19) that snugly cooperates with the cylindrical outer surface of the annular groove (10). As a result of the inclined surface (18), the end of the latching member (15) will have thin configuration allowing the annular groove (10) to be narrow, which in turn will lead to a durable and resistant movable shackle (4).

Figures 3X, 3Y, 3Z:
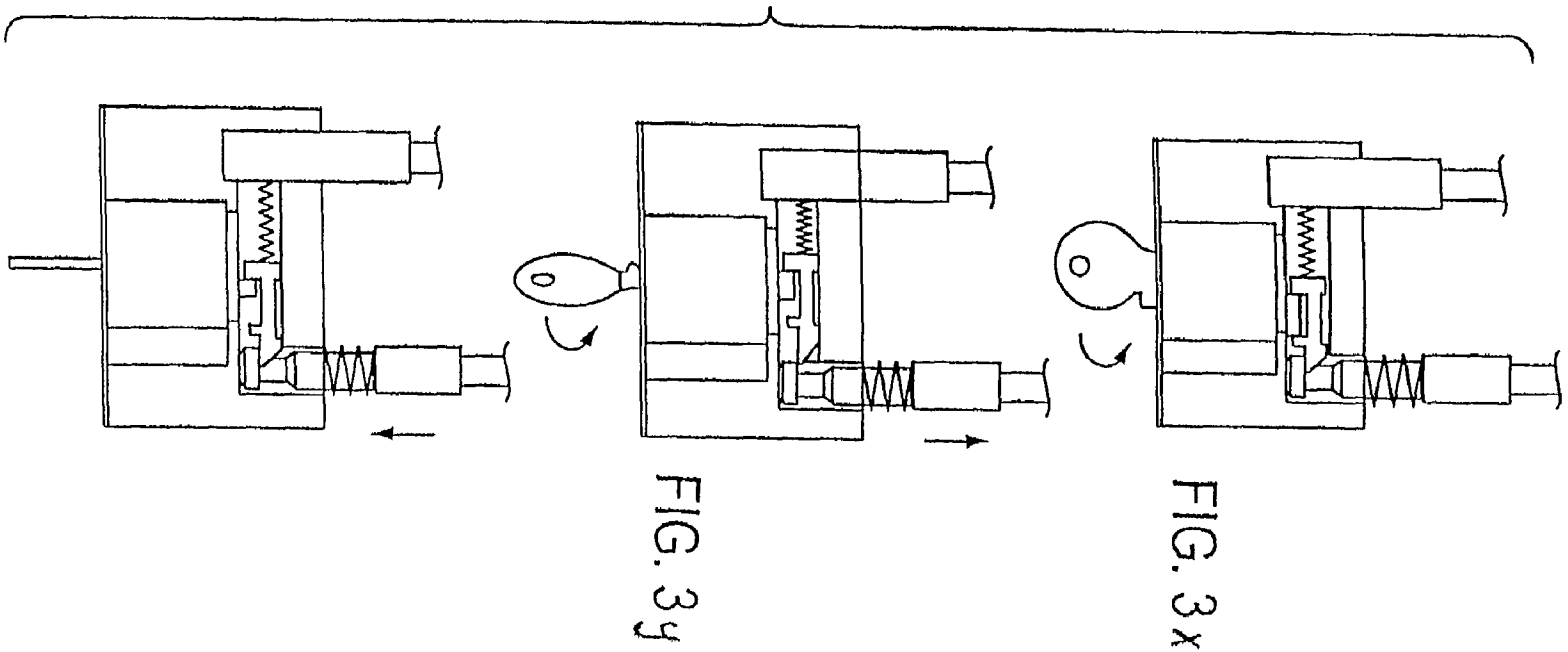
FIGS. 3*x*, 3*y*, and 3*z* is a cut-away view of the lockcase showing the relationship between the latching member, the locking mechanism and the movable shackle.

When the key (13) is inserted into the key plug (7) and turned 135 degrees, the latching member (15) is moved out of the locking position from the annular groove (10) and the spring (11) will automatically pull the movable shackle (4) out of the bore (6), opening the gunlock, as shown in FIG. 3*x* and 3*y*. After this, the key plug (7) will return to a position 90 degrees from the locking position, as shown in FIG. 3*z*.

FIGS. 2 and 3 show another embodiment of the latching member (15) wherein a rectangularly shaped tongue (20) is formed to be placed between the inner end (14) of the keyplug (7) and the outer surface of the cylindrical portion (9) of the movable shackle (4) for further enforcing the stability of the latching member (15) in the locked position during an impact. When the gunlock is locked, the tongue (20) rests against the inner end (14) of the keyplug (7) impeding the movement of the latching member (15) toward the fixed shackle (3).

Whereas this invention has been described with respect to the above mentioned embodiments, it should be realized that various changes may be made without departing from the essential contributions to the art made by the teachings thereof.

What is claimed is:

1. A gunlock comprising:

a lock case having at least one bore for receiving a shackle end, at least one movable shackle including a cylindrical end portion provided with an annular groove, a shackle spring mounted on said cylindrical end portion outside of the lock case, a key plug having an inner end, a latching member with an inner recess arranged to react with the inner end of the key plug when in a locked position to impede the movement of the latching member, said latching member further includes an inwardly cut semicircular shaped edge cooperating with said annular groove, a spring urging said latching member towards said cylindrical end portion, and the inner end of said key plug to drive said latching member in and out of cooperation with said annular groove.

2. A gunlock according to claim 1 wherein said shackle spring is abutting against an outer surface of the lock case.

3. A gunlock according to claim 1 wherein said latching member has an inverted U-shaped structure, including said inner recess.

4. A gunlock according to claim 3, wherein said inner recess has a rectangular shape.

5. A gunlock according to claim 1 wherein said latching member includes a tongue placed between said cylindrical end portion and said inner end.

6. A gunlock according to claim 1 wherein said latching member includes at least one downwardly inclined surface.

* * * * *